US006644194B2

(12) United States Patent
Yamamoto et al.

(10) Patent No.: US 6,644,194 B2
(45) Date of Patent: Nov. 11, 2003

(54) SYSTEM AND METHOD FOR AUTOMATICALLY OPTIMIZING A CONTROL QUANTITY FOR A PRINTER

(75) Inventors: Shouji Yamamoto, Hiroshima-ken (JP); Sakio Nakamura, Hiroshima-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/184,924

(22) Filed: Jul. 1, 2002

(65) Prior Publication Data

US 2003/0049064 A1 Mar. 13, 2003

(30) Foreign Application Priority Data

Jul. 4, 2001 (JP) ..... 2001-203947

(51) Int. Cl.[7] ..... B41F 1/54; B41F 31/02
(52) U.S. Cl. ..... 101/484; 101/365
(58) Field of Search ..... 101/484, 349.1, 101/365; 400/76; 358/1.15, 1.1, 1.14

(56) References Cited

U.S. PATENT DOCUMENTS 5,625,758 A * 4/1997 Schneider et al. ..... 358/1.15
5,652,831 A * 7/1997 Huang et al. ..... 345/604
5,884,562 A * 3/1999 Sugiyama et al. ..... 101/484
6,024,018 A * 2/2000 Darel et al. ..... 101/365
6,230,622 B1 5/2001 Dilling ..... 101/484
6,367,385 B2 * 4/2002 Komori ..... 101/484
6,412,412 B1 * 7/2002 Michaud et al. ..... 101/365
6,441,914 B1 * 8/2002 Barak et al. ..... 358/1.14
6,453,812 B1 * 9/2002 Ikeda et al. ..... 101/365

FOREIGN PATENT DOCUMENTS

| | | |
|---|---|---|
| JP | 4-221642 | 8/1992 |
| JP | 5057879 | 3/1993 |
| JP | 7076069 | 3/1995 |
| JP | 7-164619 | 6/1995 |
| JP | 11-342597 | 12/1999 |

* cited by examiner

*Primary Examiner*—Andrew H. Hirshfeld
*Assistant Examiner*—Wasseem H. Hamdan
(74) *Attorney, Agent, or Firm*—Armstrong, Westerman & Hattori, LLP

(57) ABSTRACT

Disclosed herein are an operation support unit, an operation support system, and an operation support method capable of supporting operation of a printer with reliability and stability. A suppression factor that is suppressed is set according to a control mode, and a plurality of control objects for the printer, effective in suppressing the suppression factor, is allocated as a control group. Then, a set of data that is under printing conditions nearly coinciding with the present predetermined printing conditions is collected from among a plurality of data sets in which printing conditions, printing-quality information, and mechanical information are correlated. Next, for each suppression factor, a principal axis component which represents the distributed characteristic of the collected set of data is set as a characteristic line for the control objects selected as said control group, and control quantities for the control objects are set based on the characteristic line in order to suppress the suppression factor.

17 Claims, 8 Drawing Sheets

SYSTEM AND METHOD FOR AUTOMATICALLY OPTIMIZING A CONTROL QUANTITY FOR A PRINTER

BACKGROUND OF THE INVENTION

1) Field of the Invention

The present invention relates to an operation support unit, an operation support system, and an operation support method that automatically optimize a control quantity for each control object of a printer.

2) Description of the Related Art

In printers, the degree of ink key opening, the quantity of dampening water, and the adjustment quantities to paper supplying and discharging sections, are important control quantities that have an influence upon the quality of a print. It is necessary that these control quantities be suitably adjusted for each job according to printing conditions (e.g., ink kind, paper kind, an image area rate, etc.). Adjustments to the control quantities depend on the skill of a person who operates a printer.

However, in the case where adjustments to the control quantities depend on the skill of an operator, there is a fear that a difference in quality between prints will occur according to the degree of operator's skill. In general, trial printing is repeatedly performed until a print of satisfactory quality (hereinafter referred to as an OK sheet) is obtained. In the case of an unskilled operator, there is a fear that a great deal of trial printing will be required until the OK sheet is obtained and therefore a large quantity of paper will be wasted. Because of this, there has been a strong demand for the development of a system capable of accurately and easily making adjustments to a control quantity according to printing conditions without depending on the skill of an operator so that a printer can be easily operated.

As such a system, an operation support system is disclosed, for example, in Japanese Laid-Open Patent Publication No. HEI 11-342597. In the support system, various kinds of control quantities for a printer are automatically controlled based on information about the interaction between control media, stored in an expert system.

In operation of a printer, to early achieve control objectives (e.g., stabilization of operation in a steady state, early starting of a printer, etc.), it is extremely important to select and control suitable control objects (which are to be controlled) from a great number of control objects for a printer according to the control objectives. In the case where a plurality of control objects must be controlled to achieve a single control objective, the quantities that the control objects are controlled (hereinafter referred to as control quantities) influence each other and therefore it is important to set optimal control quantities as a whole.

However, in the aforementioned publication, there is almost no concrete information on the above-mentioned relationship between control quantities and on a method of controlling a printer. Based on this publication, it is fairly difficult to support operation of a print with stability.

The above-mentioned publication also discloses that a great number of dispersed reference points on an n-dimension space actually detected are interpolated and, based on this, color control and density control are performed. This implies that various kinds of operation information on the interaction between control media are stored in an expert system and, based on the operation information, various control characteristics are estimated, and that based on the various control characteristics, various control quantities for a printer are set.

The aforementioned operation information, however, has errors in measurement, and errors due to the influence of various conditions that cannot be realistically taken into consideration. It is extremely important in executing the operation support of a printer with stability to estimate control characteristics with high reliability, based on a great number of data groups having such errors. In the above-mentioned publication there is no information on these points.

SUMMARY OF THE INVENTION

The present invention has been made in view of the problems described above. Accordingly, it is the primary objective of the present invention to provide an operation support unit, an operation support system, and an operation support method for a printer which are capable of supporting operation of the printer with reliability and stability.

To achieve the aforementioned objective of the present invention, there is provided an operation support unit for automatically setting control quantities of control objects for a printer, based on printing conditions for the printer, printing-quality information on a print, and mechanical information on the printer, and then outputting the set control quantities to a printer control unit which controls operation of the control objects of the printer, the operation support unit comprising:

- information storage means in which the printing conditions, the printing-quality information, and the mechanical information are correlated and stored as a sequence of data sets;
- allocation means for setting a suppression factor according to a control mode, and then allocating a plurality of control objects for the printer effective in suppressing the suppression factor, as a control group;
- information collection means for collecting a set of data that is under printing conditions nearly coinciding with the present predetermined printing conditions, from the sequence of data sets stored in the information storage means; and
- control-quantity set means for setting, for each the suppression factor, a principal axis component which represents a distributed characteristic of the data set collected by the information collection means, as a characteristic line for the control objects selected as the control group, and then setting control quantities of the control objects, based on the characteristic line in order to suppress the suppression factor.

With this construction, a characteristic line with extremely high reliability is obtained based on a set of data, and a control quantity for a control object is set based on the characteristic line. As a result, there is an advantage that for the predetermined control objects of the printer, optimum control quantities can be reliably set under the present operating condition and that operation of the printer can be supported with reliability and stability.

In the operation support unit of the present invention, the allocation means gives the orders of priority to the plurality of control objects of the control group in the order that the effect of suppressing the suppression factor is higher. The quantity set means sets within the standard operating range a control quantity for a control object whose priority order is higher, based on the characteristic line and, when the control quantity alone cannot suppress the suppression factor, sets a control quantity for the control object having the next highest priority order, based on the characteristic line.

With this construction, there is an advantage that operation support can be efficiently performed and that operation is safely performed within the standard operating range.

In the operation support unit of the present invention, when control quantities for the plurality of control objects in the control group are simultaneously preset because the suppression factor cannot be suppressed by controlling the control quantity of a single control object of the control group within the standard operating range, the control quantities are set so that the sum total of varied quantities of the control objects that are simultaneously preset becomes the minimum.

With this construction, there is an advantage that operation support can be efficiently performed.

In the operation support unit of the present invention, the information collection means collects a set of data from among the plurality of data sets stored in the information storage means, when one condition is that an overall streak rate for an image is nearly the same as the present overall streak rate.

In this case, control is performed according to the overall streak rate having a great influence on the control quantity of the control object, so that there is an advantage that operation support can be efficiently performed.

In accordance with the present invention, there is provided an operation support system comprising:

a printing condition output unit for outputting printing conditions to a printer;

a printing quality detection unit for detecting printing-quality information on a print;

a mechanical information detection unit for detecting mechanical information on the printer;

a printer control unit for controlling operation of various kinds of control objects of the printer; and the aforementioned operation support unit;

wherein the information storage means correlates the printing conditions from the printing condition output unit, the printing-quality information from the printing quality detection unit, and the mechanical information from the mechanical information detection unit and stores them as a sequence of data sets.

Furthermore, in accordance with the present invention, there is provided an operation support method of automatically optimizing control quantities of control objects for a printer, comprising the steps of:

setting an suppression factor which is suppressed according to a control mode, and then allocating a plurality of control objects for the printer effective in suppressing the suppression factor, as a control group;

collecting a set of data that is under printing conditions nearly coinciding with the present predetermined printing conditions, from a great number of data sets in which printing conditions, printing-quality information, and mechanical information are correlated; and setting, for each the suppression factor, a principal axis component which represents a distributed characteristic of the collected data set, as a characteristic line for the control objects selected as the control group, and then setting control quantities of the selected control objects, based on the characteristic line in order to suppress the suppression factor.

According to the operation support system and the operation support method of the present invention, a control group is allocated to each of the suppression factors, and a set of data that is under printing conditions nearly coinciding with the present predetermined printing conditions is collected from a great number of data sets in which printing conditions, printing-quality information, and mechanical information are correlated. And a principal axis component which represents a distributed characteristic of the collected set of data is set as a characteristic line for the control objects selected as the control group. Therefore, a characteristic line with extremely high reliability is obtained based on a set of data, and a control quantity for a control object is set based on the characteristic line. As a result, there is an advantage that for the predetermined control objects of the printer, optimum control quantities can be reliably set under the present operating condition and that operation of the printer can be supported with reliability and stability.

BRIEF DESCRIPTION OF THE DRAWINGS

The present invention will be described in further detail with reference to the accompanying drawings wherein.

DETAILED DESCRIPTION OF THE PREFERRED EMBODIMENT

A preferred embodiment of the present invention will hereinafter be described with reference to the drawings.

Figure 1:
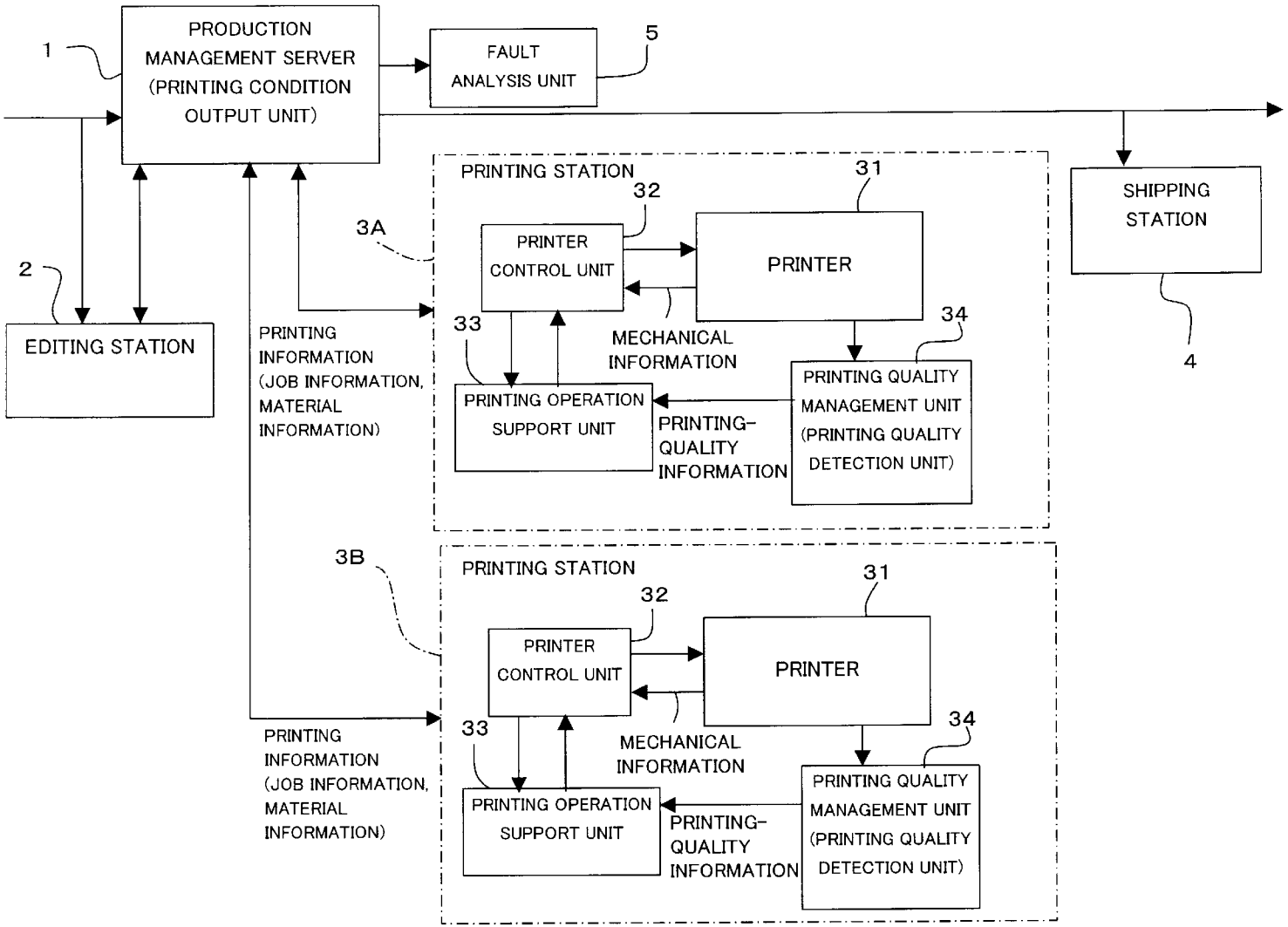
FIG. 1 is a schematic diagram showing the overall construction of an operation support system for a printer, constructed according to a preferred embodiment of the present invention.

As shown in FIG. 1, the operation support system of the preferred embodiment is equipped with a production management server (printing condition output unit) 1, an editing station 2 where printed images are edited, a plurality of printing stations (e.g., two printing stations in the preferred embodiment) 3A, 3B, a shipping station 4 in which the final process (cutting, bookbinding, etc.) for prints is performed, and a fault analysis unit 5.

Printing conditions, including a target quality for a print, are stored in the production management server 1. The production management server 1 outputs the printing conditions to the printer control units 32 of the printing stations 3A, 3B. The printing stations 3A, 3B execute printing, based on the printing conditions. The printing conditions are information on production, material, etc., and is, for example, information on a number of prints, appointed data of delivery, ink kind, paper kind, blanket kind, dampening water kind, an image area rate, and ink quantity (target color for an image). Besides, the production management server 1 outputs page information (such as bookbinding, etc.), etc., to the shipping station 4.

Because the printing stations 3A, 3B are the same in construction, a description will be given of the construction of the print station 3A. The print station 3A is equipped with a printer 31, a printer control unit 32, a printing operation support unit 33, and a printing quality management unit (printing quality detection unit) 34. Note that there are cases where the printing quality management unit 34 is shared with a plurality of printing stations.

The printer 31 is connected with various constituent units such as a paper supplying unit, a plurality of printing units, a paper discharging unit, etc. Each unit is controlled by the printer control unit 32 provided within the same print station 3A. Each unit is also provided with one or more sensors (mechanical information detection means (not shown)) for detecting the conditions of the printer 31, that is, the mechanical conditions (mechanical information). The mechanical conditions that are detected are ambient temperature, ambient humidity, printing surface temperature, printing surface humidity, paper surface temperature, paper surface humidity, printing speed, rod pressure, printing pressure, etc. The information on the mechanical conditions detected by the sensors is output to the printer control unit 32. The information on the mechanical conditions is also output to the printing operation support unit 33 through the printer control unit 32.

The printer control unit 32 also has the function of presetting the control quantities that the control objects of the printer 31 are controlled. For example, in the case of the paper supplying unit, the control objects that are controlled are a quantity of air handled, a quantity that a plate spring is pushed, a quantity of auxiliary air, etc. In the case of the printing unit, the control objects are a dampening water supply, a degree of an ink key opening, register, etc., and in the case of the paper discharging unit, they are a paper adjusting fan, a side jogger, a vacuum suction wheel, etc. If it receives the set value of each control quantity, which is to be described later, from the printing operation support unit 33, the printer control unit 32 presets each control quantity according to the set value.

The printing quality management unit 34 is used to detect and manage the quality of a printing sheet (printed matter), and is constructed to output the detected printing-quality information to the printing operation support unit 33. The printing quality used herein means, for example, a color tone such as coloring, a color reproducing region, a color difference quantity, etc.

Figure 2:
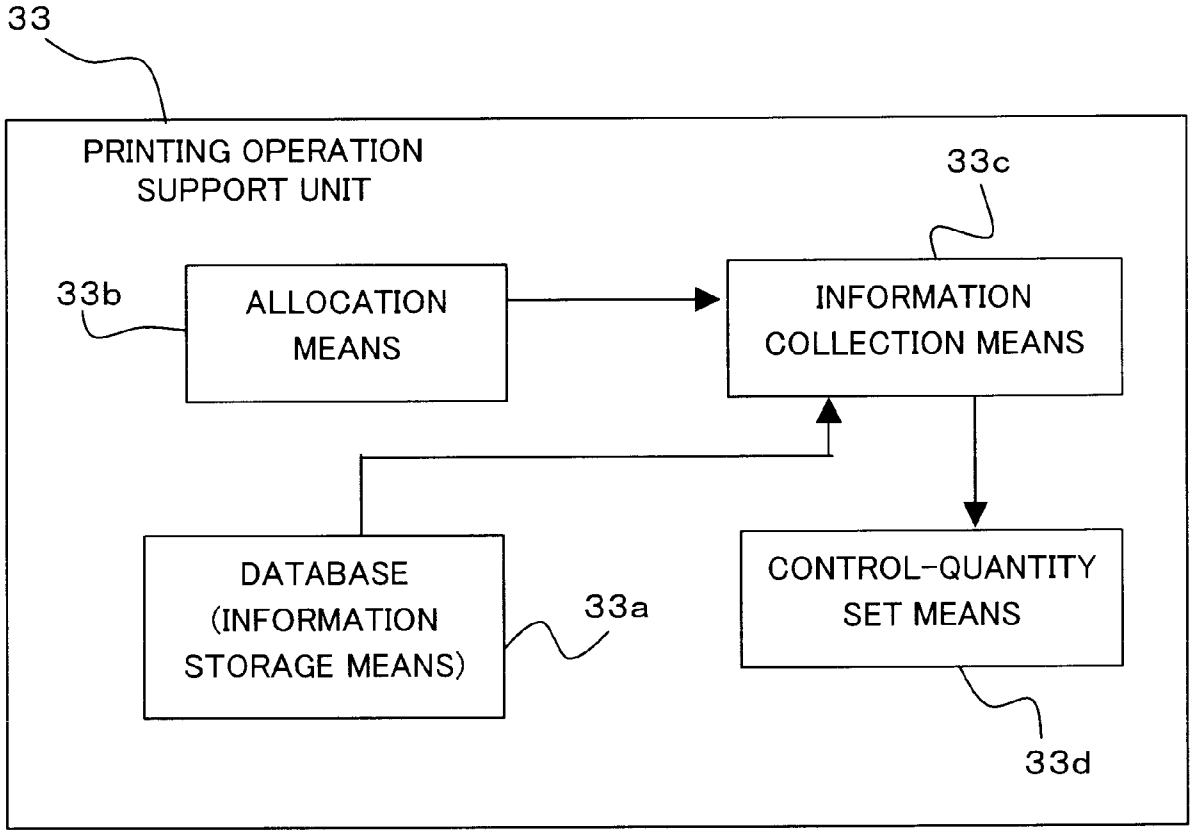
FIG. 2 is a functional block diagram schematically showing the construction of an operation support unit for a printer, constructed according to the preferred embodiment of the present invention.

Now, the construction of the printing operation support unit 33 will be described with reference to FIGS. 1 and 2. The printing operation support unit 33 has a database (information storage means) 33*a* to which various kinds of printing information are input from the production management server 1 through the printer control unit 32. In addition, various kinds of mechanical information are input from the sensors of the printer 31 to the database 33*a* through the printer control unit 32. Furthermore, various kinds of printing-quality information are input from the printing quality management unit 34 to the database 33*a*. The printing information, the mechanical information, and the printing-quality information are correlated and stored in the database 33*a* as a set of data.

The printing operation support unit 33 is also provided with allocation means 33*b*. For example, as listed in Table 1, the allocation means 33*b* sets suppression factors which should be suppressed to achieve the object of supporting operation (control mode). For each suppression factor, the allocation means 33*b* further sets an evaluation parameter, and a control group for suppressing the suppression factor.

TABLE 1

| Objects | Suppression factors | Evaluation parameters | Control groups | | | |
|---|---|---|---|---|---|---|
| a) Stabilization (steady state) | 1) Ink film thickness fluctuation | Color difference quantity A | Ink supply | Dampening water supply | Ink temperature | Oscillating amplitude |
| | 2) Color difference | Color difference | Ink supply | Dampening water | Ink temperature | Printing pressure |

TABLE 1-continued

| Objects | Suppression factors | Evaluation parameters | Control groups | | | |
|---|---|---|---|---|---|---|
| | in a halftone region | quantity B | | supply | | |
| | 3) Faults | Stains, out-of-register | Ink supply | Dampening water supply | Printing speed | |
| b) Early starting (transient state) | 1) Paper supply stoppage | Frequency of stoppages | Printing speed | Air pressure for feeding paper | Paper feeding position | Pawl height |
| | 2) Color mismatch | Color difference quantity C | Inter ink quantity | Ink supply | Water supplying method | Ink temperature |

The evaluation parameter is printing quality that becomes a specific evaluation object for ascertaining the degree of a suppression factor. The control group is a group of control objects, selected to be effective in suppressing a suppression factor. The control objects within the control group are given the orders of priority in the order that the effect of suppressing a suppression object is higher. In Table 1, the control objects with a greater suppression effect are listed on the left side.

The control-quantity set means 33*d*, which is to be described later, sets the control quantities of the control objects in the order that the effect of suppressing a suppression factor is higher, and outputs them to the printer control unit 32. In response to the control-quantity set information, the printer control unit 32 presets the control quantity of each control object.

Now, allocation by the allocation means 33*b* will be described in detail. As the object of supporting operation (i.e., as a control mode), a) the stabilization of quality under steady operation (stabilization of operation), and b) the early starting of a printer at the start of operation (in a transient state), are set. That is, the printing operation support unit 33 is provided with the function of stabilizing operation and the function of starting a printer early.

As listed in Table 1, when operation support is performed with the object of stabilizing operation, the allocation means 33*b* sets 1) ink film thickness fluctuation, 2) a color difference in a halftone region, and 3) faults as the suppression factors.

For 1) the ink film thickness fluctuation, the allocation means 33*b* further sets a color difference quantity A, which is detected based on color coordinate values (L, a, b) by the printing quantity management unit 34, as the evaluation parameter, and sets an ink supply, a dampening water supply, ink temperature, and oscillating amplitude as the control group. As described above, the control objects within the control group are given the orders of priority. Therefore, the control-quantity set means 33*d* first presets, for example, an ink supply and a dampening water supply. If these presets cannot cause the color difference quantity A to be a predetermined value or less, then the control-quantity set means 33*d* presets ink temperature and oscillating amplitude.

For 2) the color difference in a halftone region, a color difference quantity B (the color coordinate values (L, a, b) and/or dot diameter $\phi$ that is detected by the printing quality management unit 34) is set as the evaluation parameter, and an ink supply, a dampening water supply, ink temperature, and printing pressure are set as the control group. For 3) the faults, the stains and/or out-of-register that is detected by the printing quality management unit 34 is set as the evaluation parameter, and an ink supply, a dampening water supply, and printing speed are set as the control group.

Similarly, when operation support is performed with the object of starting the printer early, the allocation means 33*b* sets 1) a paper supply stoppage and 2) a color mismatch as the suppression factors. For 1) the paper supply stoppage, the allocation means 33*b* sets the frequency of stoppages that is recorded by the printer control unit 32, as the evaluation parameter, and sets printing speed, air pressure for feeding paper, paper feeding position, and pawl height as the control group. For 2) the color mismatch, a color difference quantity C that is detected by the printing quality unit 34 is set as the evaluation parameter, and an inter-printing ink quantity, an ink supply, a water supplying method, and ink temperature are set as the control group.

The printing operation support unit 33 is further provided with information collection means 33*c* and control-quantity set means 33*d*. A description will be given of how a color difference in a halftone region is suppressed by the information collection means 33*c* and the control-quantity set means 33*d* in order to stabilize operation, with reference to FIG. 3.

The information collection means 33*c* of the printing operation support unit 33 first collects the specific data sets $d_1$, $d_2$, $d_3$, . . . from the database 33*a* in order to preset the ink supply I and dampening water supply W whose priority order is higher, among the control objects set by the allocation means 33*b* as the control group for suppressing a color difference in a halftone region which is an suppression factor. Note that the specific data sets mean, the data set whose printing conditions are nearly the same as the present printing conditions, and furthermore, whose the ink temperature and printing pressure, set along with the ink supply I and the dampening water supply W as the control group for suppressing a color difference in a halftone region, are nearly equal to the presenting ink temperature and printing pressure, detected by the mechanical information detection means.

Figure 3:
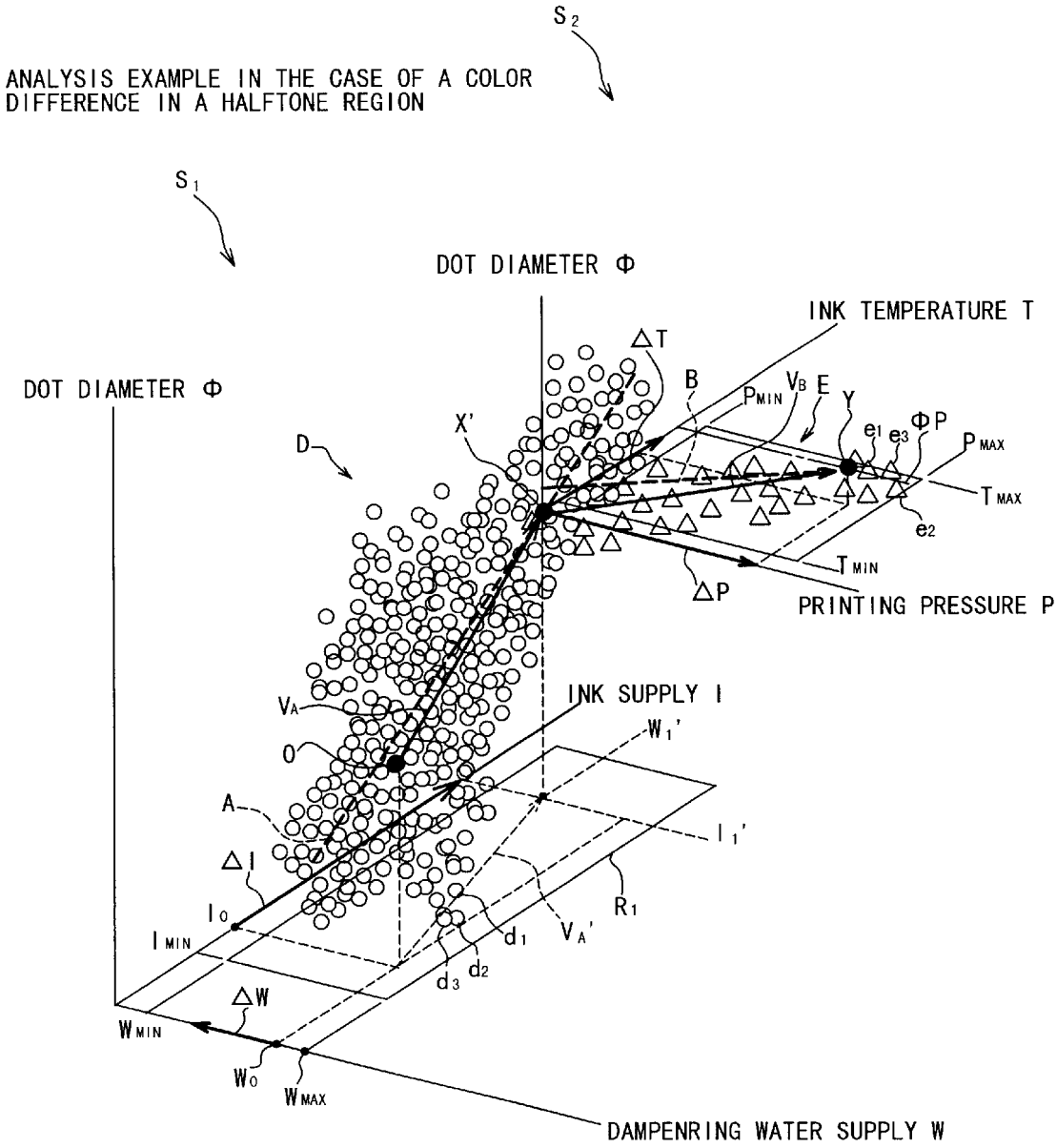
FIG. 3 is a conceptual diagram used to explain an operation support method for a printer, constructed according to the preferred embodiment, and shows a perspective view of a coordinate space.

As shown in FIG. 3, the control-quantity set means 33*d* conceptually marks the data sets $d_1$, $d_2$, $d_3$, . . . on a first-order coordinate space $S_1$ having a corresponding evaluation parameter (e.g., a dot diameter $\phi$ in this embodiment), an ink supply I, and a dampening water supply W as coordinate axes.

The data sets $d_1, d_2, d_3, \ldots$ have errors in measurement and errors due to the influence of various conditions that cannot be realistically taken into consideration, respectively. Therefore, the characteristic population D of these data sets $d_1, d_2, d_3, \ldots$ becomes a three-dimensional configuration having dispersion such as that shown in FIG. 3. Because of this, the control-quantity set means 33*d* sets a principal axis, representing the distribution characteristic of the characteristic population D, as a characteristic line A. Based on the characteristic line A, the control quantities of the control objects (ink supply I and dampening water supply W) are set without influence of the error in the data sets $d_1, d_2, d_3, \ldots$. That is, when one condition is that a control point defined by the ink supply I and the dampening water supply W is on the characteristic line A, the control quantities of the ink supply I and the dampening water supply W can be set.

In this embodiment, the principal axis component of the characteristic population D is defined in a straight line as the characteristic line A. For this reason, the characteristic line A will hereinafter be referred to as a characteristic straight line A. The principal axis component (characteristic straight line) A of the characteristic population D is calculated, for example, as follows.

The principal axis component A of the characteristic population D is found by the characteristic decomposition of the covariant matrix of data $d_1, d_2, d_3, \ldots$. If the stored data $d_1, d_2, d_3, \ldots$ are p-order points, the covariant matrix is expressed by the following Eq. (1):

$$\begin{aligned} r_1 &= [r_{11}, r_{12}, \cdots, r_{1p}]^t \\ r_2 &= [r_{21}, r_{22}, \cdots, r_{2p}]^t \\ &\vdots \\ r_N &= [r_{N1}, r_{N2}, \cdots, r_{Np}]^t \end{aligned} \tag{1}$$

The covariant matrix is also stated like the following Eq. (2):

$$\Sigma = \begin{bmatrix} c_{11} & c_{12} & \cdots & c_{1p} \\ c_{12} & c_{22} & & \vdots \\ \vdots & & \ddots & \\ c_{p1} & & \cdots & c_{pp} \end{bmatrix} \tag{2}$$

The matrix element $C_{ij}$ in Eq. (2) is expressed by the following Eq. (3):

$$\begin{aligned} c_{ij} &= \frac{1}{N-1} \cdot \sum_{k=1}^{N} (r_{ki} - ra_i)(r_{kj} - ra_j) \\ &= \frac{1}{N-1} \cdot \sum_{k=1}^{N} (r_{ki} - ra_i)(r_{ki} - ra_i)^t \end{aligned} \tag{3}$$

The "$ra_i$" in Eq. (3) is the expected value of the $i^{th}$ element of "r" and is given by the following Eq. (4):

$$ra_i = \frac{1}{N} \cdot \sum_{k=1}^{n} r_{ki} \tag{4}$$

In the principal axis component analysis, the axis with the greatest dispersion in the distribution space (characteristic population D) shown in FIG. 3 is assumed to be the first order. If all the sample spaces of the characteristic population D are taken to be Y, Y can be expressed as linear coupling like the following Eq. (5):

$$Y = \alpha_1 r_1 + \alpha_2 r_2 + \ldots + \alpha_p r_p = \vec{\alpha}^t \vec{r} \tag{5}$$

Therefore, the following Eq. (6) is determined so that Y becomes the maximum. In Eq. (6), $\alpha$ is a normalized vector and $\alpha^t \cdot \alpha$ is 1 ($\alpha^t \cdot \alpha = 1$).

$$\vec{\alpha} = [\alpha_1, \alpha_2, \ldots \alpha_p]^t \tag{6}$$

The dispersion of "Y" is expressed as $\alpha^t \cdot \Sigma \cdot \alpha$ by employing a variant matrix $\Sigma$. Since a Lagrange's method of undetermined multipliers can be applied, the problem of maximization is expressed like the following Eq. (7):

$$\begin{bmatrix} c_{11} - \lambda & c_{12} & \cdots & c_{1p} \\ c_{21} & c_{22} - \lambda & & \\ \vdots & & \ddots & \vdots \\ c_{p1} & & \cdots & c_{pp} - \lambda \end{bmatrix} \begin{bmatrix} \alpha_1 \\ \alpha_2 \\ \vdots \\ \alpha_p \end{bmatrix} = 0 \tag{7}$$

That is, the problem of maximization results in finding the solution of $(\Sigma - \lambda I) \cdot \alpha$ that is not zero. Therefore, $\lambda$ is the root of the following Eq. (8) and is the eigenvalue of $\Sigma$. In addition, $\alpha$ becomes an eigenvector.

$$|\Sigma - \alpha I| = 0 \tag{8}$$

The eigenvector $\alpha$ can be found by solving an eigenvalue equation and is the principal axis component of the characteristic population D. The principal axis component consists of a first-order component, a second-order component, . . . , and an N-order component. They represent vectors in the order of the direction where the dispersion of the population is greater, respectively. In this embodiment, the first-order principal axis component is particularly treated as the principal axis component.

As described above, various kinds of data measured are successively stored in the database 33*a*. For the data sets $d_1, d_2, d_3, \ldots$ for example, new ones are always added, so that the characteristic straight line A is optimized according to a secular change, or characteristics of each printer. Thus, the operation support control device 33 (control-quantity set means 33*d*) has a learning function. Note that the database 33*a* has stored standard data beforehand at the time of the shipment. With this standard data, a standard characteristic straight line is obtained for each control object.

Although the ink supply I and the dampening water supply W are set based on the characteristic straight line A, the ink supply I and the dampening water supply W are set within a standard operating range of $I_{MIN}$ to $I_{MAX}$ and $W_{MIN}$ to $W_{MAX}$ that are realistically operable. The standard operating range is represented on the first-order coordinate space $S_1$ of FIG. 3 as a two-dimensional range $R_1$. If a control quantity is set beyond the standard operating range $R_1$, a machine will be overloaded.

Figure 4B:
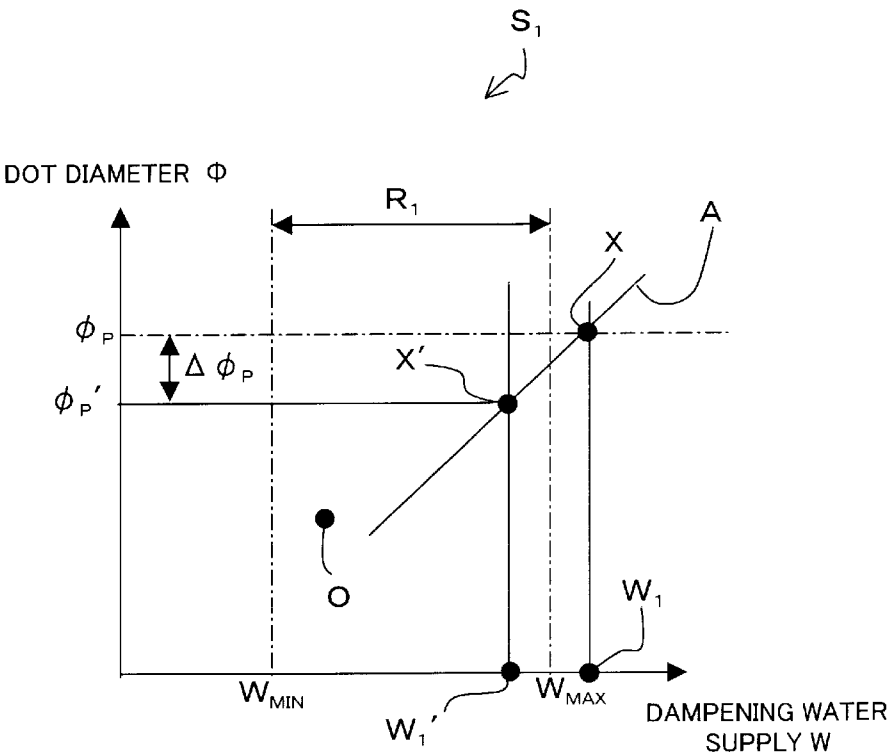
FIGS. 4A and 4B are diagrams used to explain the operation support method for a printer, constructed according to the preferred embodiment and schematically shows a coordinate system with a dot diameter and a dampening water supply as coordinate axes.
Figure 4A:
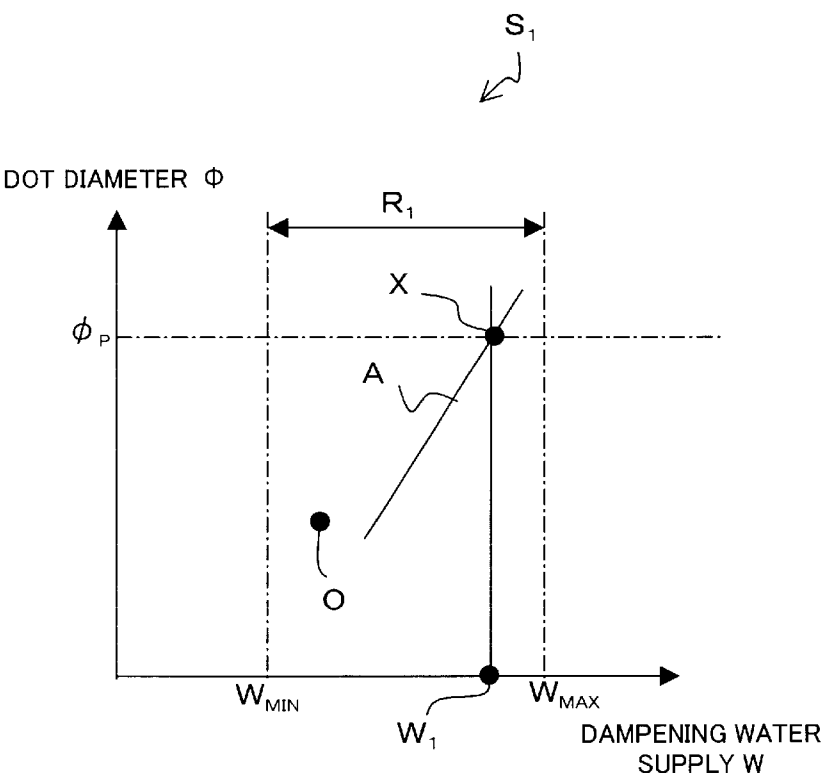

FIGS. 4A and 4B show the first-order coordinate space $S_1$ of FIG. 3 projected on a $\phi$-W plane. If the dampening water supply $W_1$ at point X being at a target dot diameter $\phi_P$ on the characteristic straight line A is within the predetermined range of $W_{MIN}$ to $W_{MAX}$ (on condition that the ink supply I is within the predetermined range of $I_{MIN}$ to $I_{MAX}$) and is within the standard operating range $R_1$, as shown in FIG. 4A, the ink supply and dampening water supply $W_1$ corresponding to the point X are set as control quantities.

On the other hand, when either the dampening water supply or ink supply (e. g., the dampening water supply $W_1$ in this example) at point X being at a target dot diameter $\phi_P$ on the characteristic straight line A is outside the standard operating range $R_1$, as shown in FIG. 4B, coordinate values $W_1'$, $I_1'$ corresponding to a predetermined coordinate point (also called a changing point) X' within the standard operating range $R_1$, instead of the point X, are used as the set values of the ink supply and the dampening water supply.

If only the control point is shifted to the coordinate point X', the target dot diameter $\phi_P$ cannot be obtained. Therefore, in order to supply a control deficiency $\Delta\phi_P(=\phi_P-\phi_P'$ where $\phi_P'$ is the dot diameter corresponding to the coordinate point X'), the ink temperature T and the printing pressure P, among the control objects set as the control group for suppressing a color difference in a halftone region, are preset in the same manner as the dampening water supply W and ink supply I, described above.

That is, first, the information collection means 33*c* collects data sets $e_1$, $e_2$, $e_3$, . . . from the database 33*a* on condition that the printing conditions are the same and that the ink supply and dampening water supply are nearly the same as the ink supply $I_1'$ and dampening water supply $W_1'$ corresponding to the changing point X'.

The control-quantity set means 33*d* conceptually marks the data sets $e_1$, $e_2$, $e_3$, . . . on a second-order coordinate space $S_2$ having the corresponding evaluation parameter (dot diameter $\phi$), ink temperature T, and printing pressure P as the coordinate axes, as shown in FIG. 3. Next, a characteristic straight line B for a characteristic population E consisting of the data sets $e_1$, $e_2$, $e_3$, . . . is calculated. In addition, a standard operating range $R_2$ of ink temperatures $T_{MIN}$ to $T_{MAX}$ and printing pressures $P_{MIN}$ to $P_{MAX}$ is set on the second-order coordinate space $S_2$.

If a predetermined coordinate point Y at a target dot diameter $\phi_P$ on the characteristic straight line B is within the standard operating range $R_2$, as shown in FIG. 3, the coordinate point Y becomes a target point and the ink temperature and printing pressure corresponding to the target point Y are used as set values. At this stage, the coordinate points X' and Y are output to the printer control unit 32. The printer control unit 32 presets the control quantities of the ink supply I, the dampening water supply W, the ink temperature T, and the printing pressure P.

On the other hand, if the coordinate point Y is outside the standard operating range $R_2$, notice is issued from the printing operation support unit 33 to the fault analysis unit 35.

Now, the method of determining the changing point X' will further be described with reference to FIG. 3. The varied quantities $\Delta W$ and $\Delta I$ of the dampening water supply W and the ink supply I, required for making a change from the present control point O to the changing point X', are the W-axis component and I-axis component of a control-quantity vector $V_A$ linking the coordinate points O and X' together. Similarly, the varied quantities $\Delta$ P and $\Delta T$ of the printing pressure P and the ink temperature T, required for making a change from the changing point X to the target point Y, are the P-axis component and T-axis component of a control-quantity vector $V_B$ linking the coordinate points X' and Y together.

The printing operation support unit 33 sets the changing point X' so that the total quantity $\beta$ of the varied quantities $\Delta W$, $\Delta I$, $\Delta P$, and $\Delta T$ become smallest. In this embodiment, the total quantity $\beta$ is calculated by the following Eq. (9):

$$\beta=K_1\times L_A+K_2\times L_B \tag{9}$$

where $L_A$ is the scalar quantity of the projected vector $V_A'$ onto the I-W plane of the control-quantity vector $V_A$ in the first-order coordinate space $S_1$, and $L_B$ is the scalar quantity of the projected vector (not shown) onto the T-P plane of the control-quantity vector $V_B$ in the second-order coordinate space $S_2$.

The scalar quantities $L_A$ and $L_B$ are scalar quantities in different coordinate spaces. In Eq. (9), adjustments between both scalar quantities are made by individually weighting the scalar quantities $L_A$ and $L_B$ with the coefficients $K_1$ and $K_2$. These coefficients $K_1$ and $K_2$ are determined, for example, by experiment.

The total quantity $\beta$ can also be calculated by the following Eq. (10):

$$\beta=K_3 33\ \Delta W+K_4\times\Delta I+K_5\times\Delta P+K_6\times\Delta T \tag{10}$$

As with Eq. (9), the varied quantities $\Delta W$, $\Delta I$, $\Delta P$, and $\Delta T$ are different physical quantities. In Eq. (10), the varied quantities $\Delta W$, $\Delta I$, $\Delta P$, and $\Delta T$ are weighted by coefficients $K_3$ to $K_6$. These coefficients $K_3$ to $K_6$ are determined, for example, by experiment.

In setting the changing point X' in the aforementioned manner so that the total quantity $\beta$ becomes the minimum, the control-quantity set means 33*d* moves a candidate point for the changing point X' along the characteristic straight line A little by little. For each movement, data sets corresponding to such a candidate point are collected from the database 33*a*; a candidate point for the target point Y is set; and the total quantity $\beta$ is calculated. By repeating these steps, a combination in which the total quantity $\beta$ becomes the minimum is used as set points X' and Y.

Of course, the definition of the total quantity $\beta$ is not limited to this, but may be set according to the actual circumstances.

As described above, the control-quantity set means 33*d* collects various kinds of information from the database 33*a* to set the characteristic straight line. In this case, various kinds of information are collected on condition that specific printing conditions are nearly the same. It is preferable that the specific printing conditions include an overall streak rate. The overall streak rate is correlated with the quantity of ink that is consumed to print a printing sheet. The control quantities of various control objects change considerably according to the overall streak rate. Therefore, if the overall streak rate is included in the printing conditions, the characteristic straight line for a control quantity and accordingly various control quantities can be made appropriate.

The operation support system and the operation support unit of the preferred embodiment of the present invention are constructed as described above. At the same as the start of printing, operation support control is performed for each of the printing stations 3A, 3B by the printing operation support unit 33 in the following method (the operation support method of the preferred embodiment of the present invention), for example. A description will hereinafter be given of the printing operation support that is performed with the object of stabilizing operation under a steady operation.

As listed in Table 1, suppression factors are first set according to the object of supporting operation. In this example, the object of supporting operation is stabilization of operation, so a fluctuation in ink film thickness, a color difference in a halftone region, and faults are set as the suppression factors. At the same time, evaluation parameters are set for the suppression factors, and the control group is allocated. The control objects in the control group are given the orders of priority so that they are preset in the order that the effect of suppressing a suppression factor is higher (first step).

Figure 5:
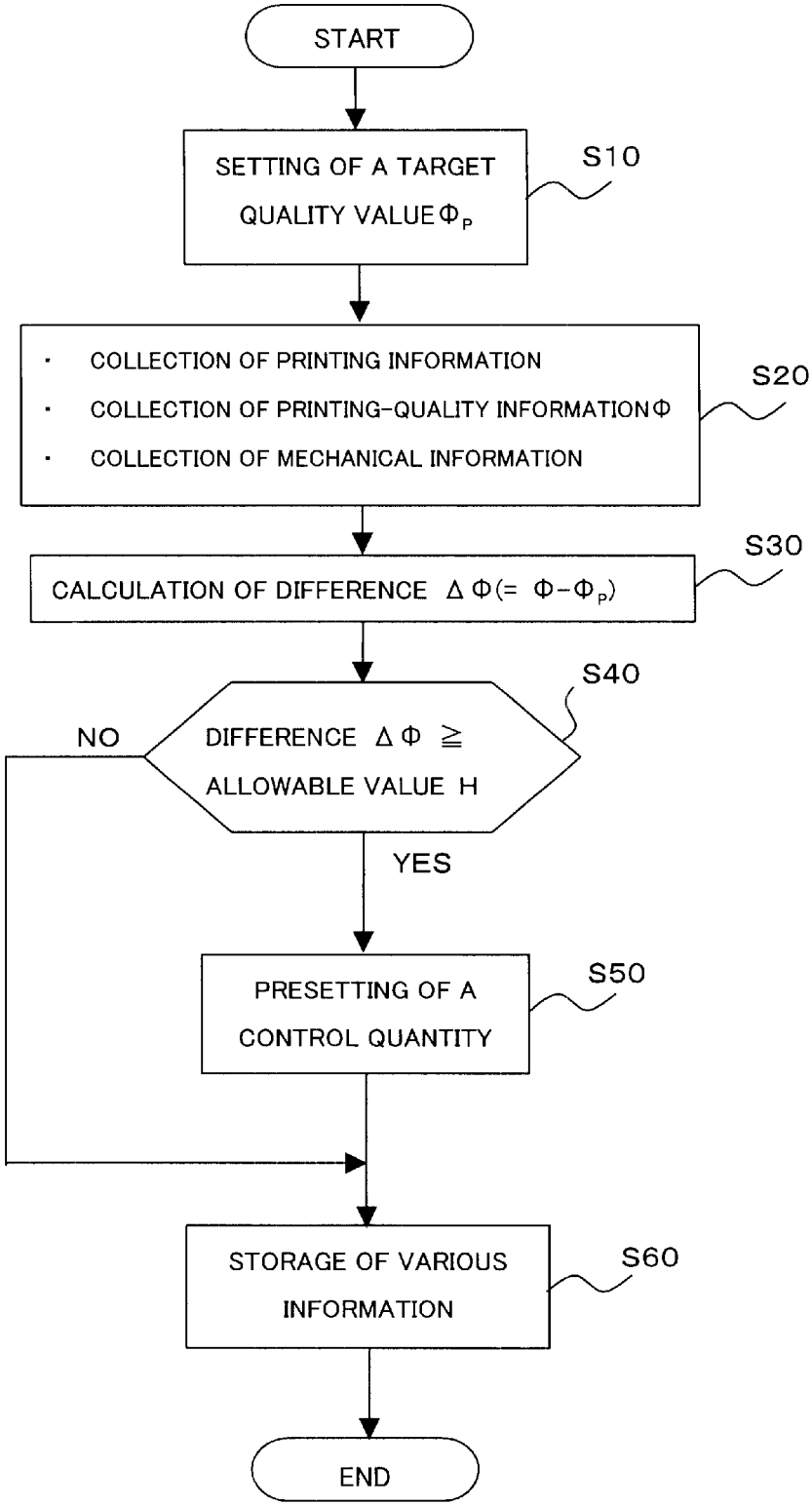
FIG. 5 is a schematic flowchart used to explain the operation support method for a printer of the preferred embodiment.

For the suppression factors (a fluctuation in ink film thickness, a color difference in a halftone region, and faults), predetermined control objects are preset as shown in a flowchart of FIG. 5. A description will hereinafter be made in the case of the suppression factor being a color difference in a halftone region. In step S10, the output of a target value (e.g., the target dot diameter $\phi_P$ in this example) for an evaluation parameter is required of the production management server 31 and is collected.

Next, in step S20, the present printing conditions (material information such as paper kind, ink kind, etc., and production information such as a planned number of prints, etc.) are collected from the production management server 31. In addition, predetermined printing-quality information (e.g., the dot diameter $\phi$ in this example) is collected from the printing quality management unit 34, and various kinds of mechanical information, such as an ink supply, a dampening water supply, etc., are collected from various sensors of the printer 31.

In step S30, a difference $\Delta\phi$ ($=\phi-\phi_P$) between the target value $\phi_P$ collected in step S10 and the dot diameter detection information $\phi$ collected in step S20 is calculated. In step S40, it is decided whether or not the difference $\Delta\phi$ is equal to or greater than an allowable value H. If the difference $\Delta\phi$ is less than the allowable value H, the control process advances to step S60 through NO route. In step S60, the present printing conditions, quality information, and mechanical information collected in step S20 are correlated and stored in the database 33*a*, and the control process ends. Note that the allowable value H, along with the target dot diameter $\phi_P$, is output in step S10 from the production management server 31 to the printing operation support unit 33. On the other hand, if the difference $\Delta\phi$ is equal to or greater than the allowable value H, the control process advances to step S50 through YES route, in which a control quantity is set.

Figure 6:
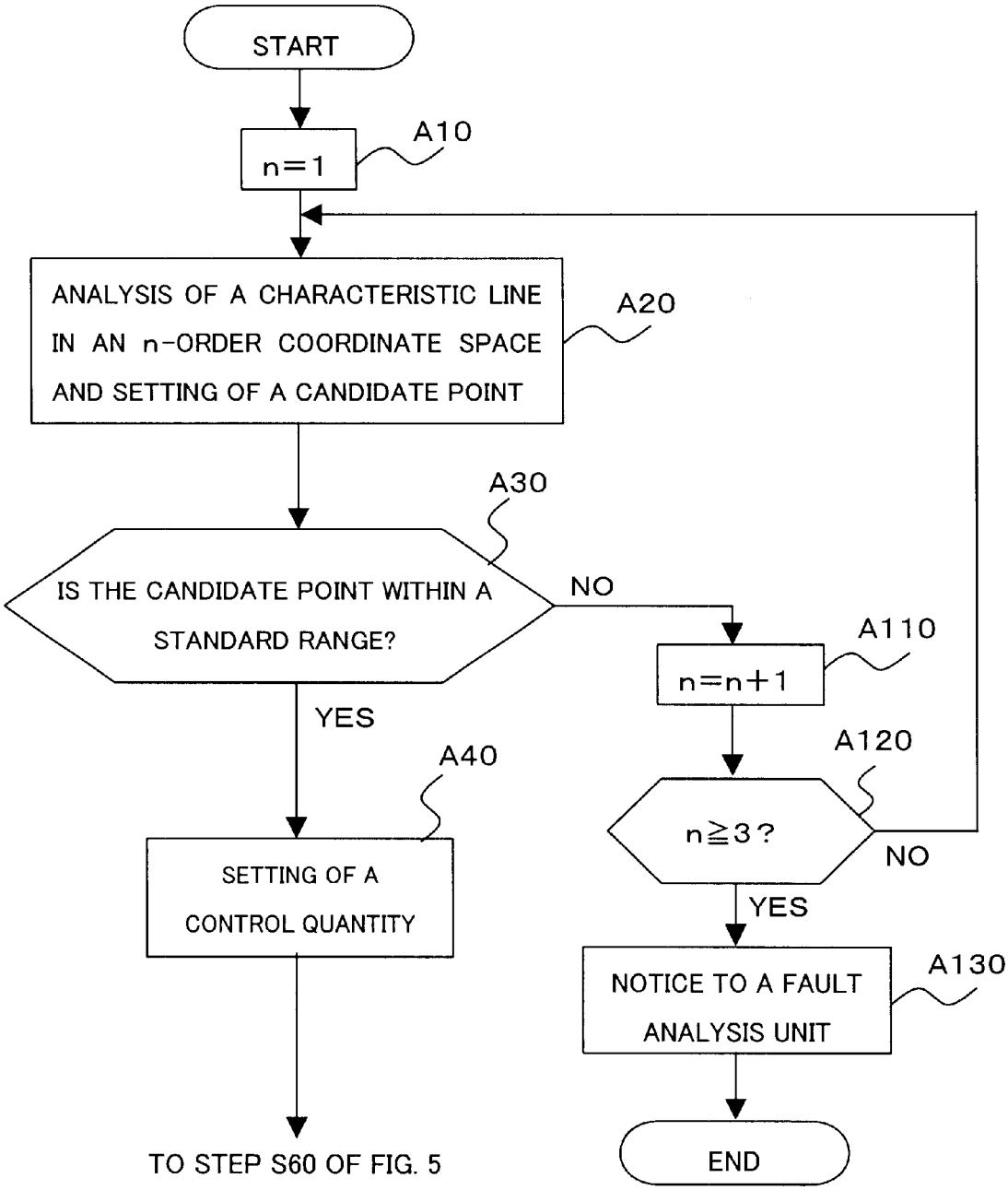
FIG. 6 is a schematic flowchart used to explain the operation support method for a printer of the preferred embodiment.

The setting of the control quantity in step S50 of FIG. 5 is performed as shown in a flowchart of FIG. 6. In step A10, a variable n that is to be described later is set at 1 (n=1). And advantage to step A20, in step A20 (second and third steps), one or more control objects (e.g., the ink supply I and dampening water supply W in this example) that are preset are selected from the control group in the order that the order of priority is higher. Next, an n-order coordinate space $S_1$ (e.g., the first-order coordinate space in this example), consisting of these control objects and an evaluation parameter (e.g., the dot diameter $\phi$ in this example) corresponding to the control objects, is set as shown in FIG. 2.

Next, the data sets $d_1$, $d_2$, $d_3$, . . . under the printing conditions nearly equal to the present printing conditions detected in step S20 of FIG. 5 are collected from among the data sets stored in the database 33*a* (for instance, if an a-kind of paper and a b-kind of ink are presently being used, data sets corresponding to the a-kind of paper and b-kind of ink are collected). Thereafter, the data sets $d_1$, $d_2$, $d_3$, . . . are marked on the first-order coordinate space S1, and a characteristic straight line A for a control quantity is set. As shown in FIGS. 4A and 4B, a control point X, on the characteristic straight line A and at a target quality value (target dot diameter $\phi_P$ in this example), is treated as a candidate point.

Next, in step A30 it is decided whether or not the candidate point X is within the standard operating range $R_1$. If the candidate point X is within the standard operating range $R_1$, as shown in FIG. 4A, it is assumed that there is no fear that even if a control point for the printer 31 is shifted to the candidate point X, the printer 31 will be overloaded. In step A40, the coordinate values corresponding to the control point X are set as the set values of the ink supply I and dampening water supply W.

In step A30, when it is decided that the candidate point X is outside the standard operating range $R_1$, as shown in FIG. 4B, the control process advances to step A110. In step A110 the variable n is incremented by 1 (n=n+1). In this case, a control point X' within the standard operating range $R_1$ is regarded as a temporary changing point.

And in step A120, it is decided whether or not the variable n is 3 or more. If it is less than 3, the control process advances to step A20. In step A20, control objects whose priority order is the second highest in the control group (the ink temperature T and printing pressure P in this example) are selected and an n-order (second-order) coordinate space $S_2$ is set. In the coordinate space $S_2$, a characteristic straight line $V_B$ is determined. Based on the characteristic straight line $V_B$, a candidate point Y is determined while setting a changing point X' so that the sum total of the control quantities of the ink supply I, the dampening water supply W, and the ink temperature T, and printing pressure p becomes the minimum.

In step A30, when it is decided that the candidate point Y is within the standard operating range $R_2$, the control process advances to step A40. In step A40, the coordinate values corresponding to the candidate points X' and Y are set as the set values of the ink supply I, dampening water supply W, ink temperature T, and printing pressure P. The control process advances to step S60 of the flowchart of FIG. 5 and ends. These set values are output to the printer control unit 32, and the control quantities of the control objects are actually preset.

In step A120, if the variable n is equal to or greater than 3, the control process advances to step A130. In step A130, notice is issued to the fault analysis unit 5, and operation support ends forcibly.

Thus, in the operation support unit, operation support system, and operation support method of the present invention, suppression factors are set according to the object of supporting operation, and control objects whose effect of suppressing a suppression factor is high are selected beforehand as a control group. Furthermore, the control objects in the control group are preferentially preset in the order that the effect of suppressing a suppression factor is higher. As a result, there is an advantage that the suppressing of a suppression factor and accordingly operation support can be efficiently performed.

In addition, a control quantity is controlled based on the characteristic straight line that represents the overall distributed characteristic of a characteristic population consisting of a plurality of values measured. As a result, there is an advantage that control can be performed with high reliability. Furthermore, since the quantities that the control objects are controlled are determined so that the sum total of the control quantities becomes the minimum, there is an advantage that operation support can be efficiently performed.

Because various kinds of measured values are stored in the database 33*a*, the control-quantity setting line that is set based on the measured values is optimized according to the individual characteristic and secular change of a printer. Consequently, there is an advantage that the operation support control itself is optimized according to the individual characteristic and secular change of a printer.

While the present invention has been described with reference to the preferred embodiment thereof, the invention is not to be limited to the details given herein, but may be modified within the scope of the invention hereinafter claimed.

Figure 7:
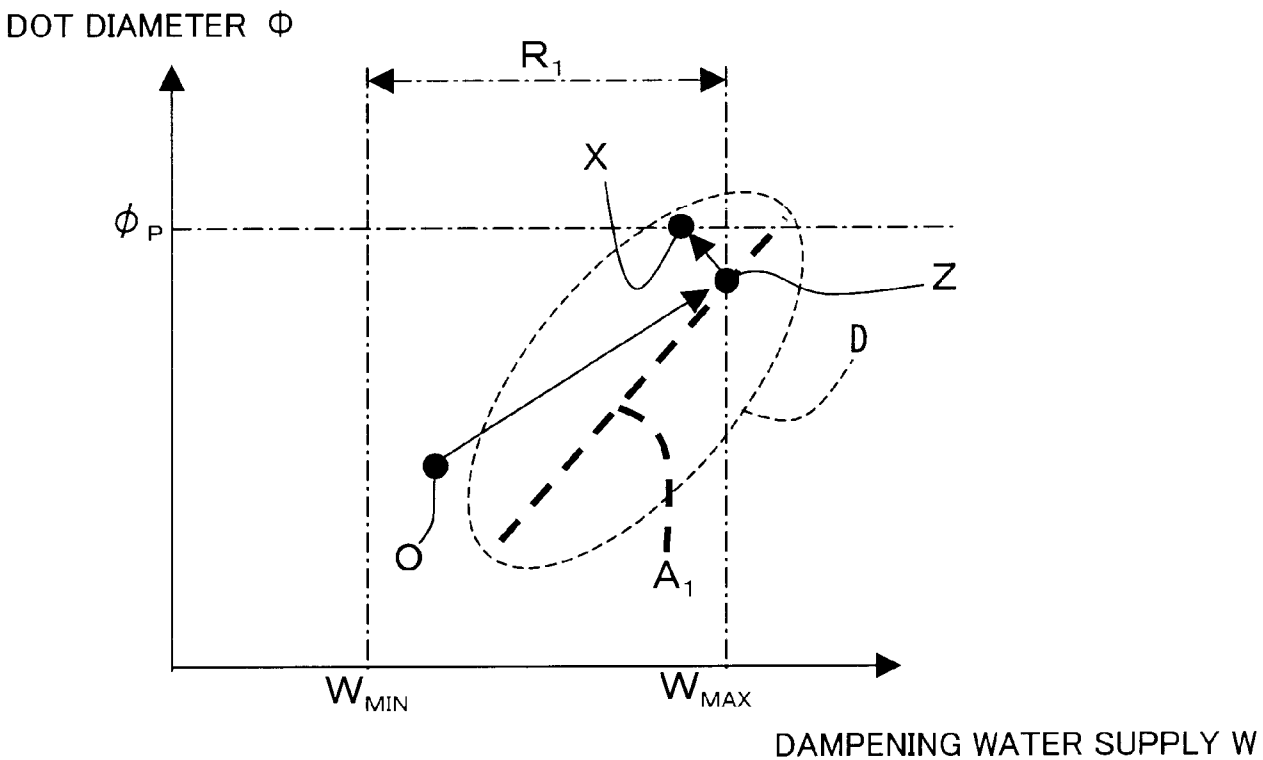
FIG. 7 is a diagram used for explaining a modification of the operation support method for a printer, constructed according to the preferred embodiment and schematically shows a coordinate system with a dot diameter and a dampening water supply as coordinate axes.

For example, in the preferred embodiment, when the characteristic straight line for a control quantity does not reach a target value within the standard operating range, a control object is changed. However, control can be performed as shown in a coordinate space (represented by a W–$\phi$ coordinate plane) of FIG. 7. That is, if a control object (e.g., the dampening water supply W in this embodiment) is controlled along the characteristic straight line $A_1$ so that an evaluation parameter (e.g., the dot diameter $\phi$ in this embodiment) reaches a target dot diameter $\phi_P$, the control point will be outside the standard operating range $R_1$. For this reason, the control point on characteristic straight line $A_1$ is set as a relay point Z so that within the standard operating range $R_1$, the dot diameter $\phi$ is as close to the target dot diameter $\phi_P$ as possible.

After the dampening water supply W, etc., are actually controlled at a set quantity (e.g., $W_{MAX}$ for the dampening water supply W in this embodiment) corresponding to the relay point Z, a control point, within the standard operating range $R_1$ and corresponding to the target dot diameter $\phi_P$, is set as a target point X. Note that the target point X is selected so that the total varied quantity $\beta$ of the dampening water supply W and dot diameter I between the relay point Z and the target point X becomes the minimum.

Such control can be performed with stability, because a control point is set within the standard operating range $R_1$.

Since presetting of the dampening water W and ink supply I alone cannot suppress a color difference in a halftone region, as described above, the ink temperature T and printing pressure P are further preset. In the preferred embodiment of the present invention, the set values of the dampening water supply W, ink supply I, ink temperature T, and printing pressure P are first determined by the printing support device 33 and then these set values are output to the printer control unit 32. At the same time, the control quantities are varied.

In contrast to this, after the dampening water supply W and the ink supply I are actually varied, setting and varying of the ink temperature T and the printing pressure P may be performed. In the case where the dot diameter does not reach a target value even if the ink temperature T and the printing pressure P are preset in combination with each other, the control quantities may be varied by gradually varying a combination of these control objects within the control group until the dot diameter reaches a target value. For instance, after the ink temperature T and the printing pressure P are preset in combination with each other, the dampening water supply W and the ink temperature T may be preset at the same time in combination with each other.

Figure 8:
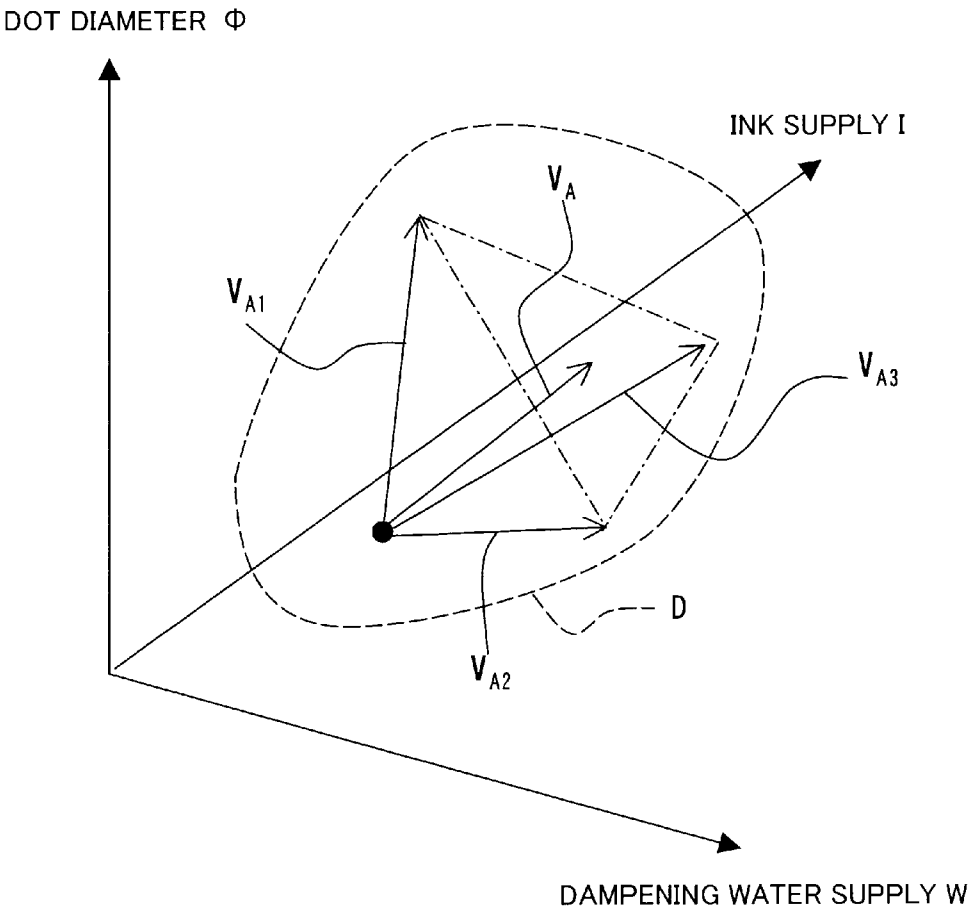
FIG. 8 is a diagram used for explaining another modification of the operation support method for a printer, constructed according to the preferred embodiment and schematically shows a coordinate system with a dot diameter, a dampening water supply, and an ink supply as coordinate axes.

In the preferred embodiment, the characteristic population D is elliptical in shape, as shown in FIG. 3. In this case, a single representative principal axis component can be specified as the characteristic straight line A for a control quantity. As shown in FIG. 8, in the case where the characteristic population D has a plurality of representative principal axis components (e.g., three principal axis components shown in FIG. 8), a control-quantity vector $V_A$ can be determined in the following manner.

That is, the control-quantity vectors $V_{A1}$, $V_{A2}$, and $V_{A3}$ with respect to the principal axis components are first determined from these principal axis components and the contribution ratios, and then the total of the control-quantity vectors $V_{A1}$, $V_{A2}$, and $V_{A3}$ is determined as a final control-quantity vector $V_A$.

Although the characteristic line (principal axis component) in the preferred embodiment is set as a straight line, it is suitably set according to the distributed state of the characteristic population D and therefore there are cases where it is set as a curved line.

What is claimed is:

1. An operation support unit for automatically setting control quantities of control objects for a printer, based on printing conditions for said printer, printing-quality information on a print, and mechanical information on said printer, and then outputting the set control quantities to a printer control unit which controls operation of the control objects of said printer, said operation support unit comprising:

information storage means in which said printing conditions, said printing-quality information, and said mechanical information are correlated and stored as a sequence of data sets;

allocation means for setting an suppression factor that is suppressed according to a control mode, and then allocating a plurality of control objects for said printer effective in suppressing said suppression factor, as a control group;

information collection means for collecting a set of data that is under printing conditions nearly coinciding with the present predetermined printing conditions, from said sequence of data sets stored in said information storage means; and control-quantity set means for setting, for each said suppression factor, a principal axis component which represents a distributed characteristic of said data set collected by said information collection means, as a characteristic line for said control objects selected as said control group, and then setting control quantities of said control objects, based on said characteristic line in order to suppress said suppression factor.

2. The operation support unit as set forth in claim 1, wherein said control-quantity set means sets a standard operating range for each of said control objects and sets said control quantity within said standard operating range.

3. The operation support unit as set forth in claim 2, wherein said allocation means gives the orders of priority to said plurality of control objects of said control group in the order that the effect of suppressing said suppression factor is higher; and said quantity set means sets within said standard operating range a control quantity for a control object whose priority order is higher, based on said characteristic line and, when said control quantity alone cannot suppress said suppression factor, sets a control quantity for the control object having the next highest priority order, based on said characteristic line.

4. The operation support unit as set forth in claim 3, wherein, when control quantities for said plurality of control objects in said control group are simultaneously preset because said suppression factor cannot be suppressed by controlling the control quantity of a single control object of said control group within said standard operating range, said control quantities are set so that the sum total of varied quantities of said control objects that are simultaneously preset becomes the minimum.

5. The operation support unit as set forth in claim 1, wherein said information collection means collects a set of data from among said plurality of data sets stored in said information storage means, when one condition is that an overall streak rate for an image is nearly the same as the present overall streak rate.

6. The operation support unit as set forth in claim 2, wherein said information collection means collects a set of data from among said plurality of data sets stored in said information storage means, when one condition is that an overall streak rate for an image is nearly the same as the present overall streak rate.

7. The operation support unit as set forth in claim 3, wherein said information collection means collects a set of data from among said plurality of data sets stored in said information storage means, when one condition is that an overall streak rate for an image is nearly the same as the present overall streak rate.

8. The operation support unit as set forth in claim 4, wherein said information collection means collects a set of data from among said plurality of data sets stored in said information storage means, when one condition is that an overall streak rate for an image is nearly the same as the present overall streak rate.

9. An operation support system comprising:

a printing condition output unit for outputting printing conditions to a printer;

a printing quality detection unit for detecting printing-quality information on a print;

a mechanical information detection unit for detecting mechanical information on said printer;

a printer control unit for controlling operation of various kinds of control objects of said printer; and the operation support unit as set forth in claim 1;

wherein said information storage means correlates said printing conditions from said printing condition output unit, said printing-quality information from said printing quality detection unit, and said mechanical information from said mechanical information detection unit and stores them as a sequence of data sets.

10. An operation support system comprising:

a printing condition output unit for outputting printing conditions to a printer;

a printing quality detection unit for detecting printing-quality information on a print;

a mechanical information detection unit for detecting mechanical information on said printer;

a printer control unit for controlling operation of various kinds of control objects of said printer; and the operation support unit as set forth claim 2;

wherein said information storage means correlates said printing conditions from said printing condition output unit, said printing-quality information from said printing quality detection unit, and said mechanical information from said mechanical information detection unit and stores them as a sequence of data sets.

11. An operation support system comprising:

a printing condition output unit for outputting printing conditions to a printer;

a printing quality detection unit for detecting printing-quality information on a print;

a mechanical information detection unit for detecting mechanical information on said printer;

a printer control unit for controlling operation of various kinds of control objects of said printer; and the operation support unit as set forth in claim 3;

wherein said information storage means correlates said printing conditions from said printing condition output unit, said printing-quality information from said printing quality detection unit, and said mechanical information from said mechanical information detection unit and stores them as a sequence of data sets.

12. An operation support system comprising:

a printing condition output unit for outputting printing conditions to a printer;

a printing quality detection unit for detecting printing-quality information on a print;

a mechanical information detection unit for detecting mechanical information on said printer;

a printer control unit for controlling operation of various kinds of control objects of said printer; and the operation support unit as set forth in claim 4;

wherein said information storage means correlates said printing conditions from said printing condition output unit, said printing-quality information from said printing quality detection unit, and said mechanical information from said mechanical information detection unit and stores them as a sequence of data sets.

13. An operation support system comprising:

a printing condition output unit for outputting printing conditions to a printer;

a printing quality detection unit for detecting printing-quality information on a print;

a mechanical information detection unit for detecting mechanical information on said printer;

a printer control unit for controlling operation of various kinds of control objects of said printer; and the operation support unit as set forth in claim 5;

wherein said information storage means correlates said printing conditions from said printing condition output unit, said printing-quality information from said printing quality detection unit, and said mechanical information from said mechanical information detection unit and stores them as a sequence of data sets.

14. An operation support system comprising:

a printing condition output unit for outputting printing conditions to a printer;

a printing quality detection unit for detecting printing-quality information on a print;

a mechanical information detection unit for detecting mechanical information on said printer;

a printer control unit for controlling operation of various kinds of control objects of said printer; and the operation support unit as set forth in claim 6;

wherein said information storage means correlates said printing conditions from said printing condition output unit, said printing-quality information from said printing quality detection unit, and said mechanical information from said mechanical information detection unit and stores them as a sequence of data sets.

15. An operation support system comprising:

a printing condition output unit for outputting printing conditions to a printer;

a printing quality detection unit for detecting printing-quality information on a print;

a mechanical information detection unit for detecting mechanical information on said printer;

a printer control unit for controlling operation of various kinds of control objects of said printer; and the operation support unit as set forth in claim 7;

wherein said information storage means correlates said printing conditions from said printing condition output unit, said printing-quality information from said printing quality detection unit, and said mechanical information from said mechanical information detection unit and stores them as a sequence of data sets.

16. An operation support system comprising:

a printing condition output unit for outputting printing conditions to a printer;

a printing quality detection unit for detecting printing-quality information on a print;

a mechanical information detection unit for detecting mechanical information on said printer;

a printer control unit for controlling operation of various kinds of control objects of said printer; and the operation support unit as set forth in claim 8;

wherein said information storage means correlates said printing conditions from said printing condition output unit, said printing-quality information from said printing quality detection unit, and said mechanical information from said mechanical information detection unit and stores them as a sequence of data sets.

17. An operation support method of automatically optimizing control quantities of control objects for a printer, comprising the steps of:

setting an suppression factor which is suppressed according to a control mode, and then allocating a plurality of control objects for said printer effective in suppressing said suppression factor, as a control group;

collecting a set of data that is under printing conditions nearly coinciding with the present predetermined printing conditions, from a great number of data sets in which printing conditions, printing-quality information, and mechanical information are correlated; and setting, for each said suppression factor, a principal axis component which represents a distributed characteristic of said collected data set, as a characteristic line for said control objects selected as said control group, and then setting control quantities of said selected control objects, based on said characteristic line in order to suppress said suppression factor.

* * * * *